United States Patent [19]

Burns et al.

[11] Patent Number: 4,780,929

[45] Date of Patent: Nov. 1, 1988

[54] HINGE STRUCTURE

[75] Inventors: David B. Burns, Santa Barbara; Joseph C. Mastroianni, Carpinteria, both of Calif.

[73] Assignee: Gen-Fold Corporation, Santa Barbara, Calif.

[21] Appl. No.: 38,848

[22] Filed: Apr. 15, 1987

[51] Int. Cl.[4] ..... E05D 11/10

[52] U.S. Cl. ..... 16/349; 16/343; 16/352; 16/358; 16/360; 16/370; 280/603

[58] Field of Search ..... 16/349, 348, 319, 345, 16/343, 352, 358, 360, 361, 362, 366, 368, 370, 369; 280/603; 84/267, 293; 292/327

[56] References Cited

. U.S. PATENT DOCUMENTS

| | | | |
|---|---|---|---|
| 1,282,435 | 10/1918 | Korb . | |
| 1,302,178 | 4/1919 | Korb . | |
| 1,567,359 | 12/1925 | De Wick . | |
| 1,747,650 | 2/1930 | Sawyer . | |
| 1,810,508 | 6/1931 | Walter . | |
| 2,018,909 | 10/1935 | Anderson . | |
| 2,021,702 | 11/1935 | Soss . | |
| 2,367,528 | 1/1945 | Rollins . | |
| 2,590,991 | 4/1952 | McDonald . | |
| 3,834,266 | 9/1974 | Robinson . | |
| 3,881,221 | 5/1975 | Schmidt | 16/360 |
| 4,073,211 | 2/1978 | Jorgensen . | |
| 4,125,273 | 11/1978 | Rothmayer . | |
| 4,262,924 | 4/1981 | Corwin . | |
| 4,415,190 | 11/1983 | Finck et al. | 292/327 |

FOREIGN PATENT DOCUMENTS

| | | |
|---|---|---|
| 2429471 | 6/1978 | France . |
| 78879 | 7/1951 | Norway . |

*Primary Examiner*—Nicholas P. Godici
*Assistant Examiner*—Gerard M. Reid
*Attorney, Agent, or Firm*—Amster, Rothstein & Ebenstein

[57] ABSTRACT

A floating hinge of the type which is composed of a lower member and an upper member each having a surface face and a channel including a pair of guideways located at their distal ends. A first arm and a second arm are employed to connect the upper member and the lower member and to provide movement of the members between an open position and a closed position. The first arm has a fixed end pivotably fixed to the lower member and a sliding end pivotably and slidably fixed to the upper member. The second arm has a fixed end pivotably affixed to the upper member and a sliding end pivotably and slidably fixed to the lower member. The sliding ends of the arms are pivotably and slidably affixed to their respective upper or lower member by a pin engaging an eccentrically fixed orifice of a pair of floating hinge slides fitted within the guideways of the channels of the upper and lower members. Means can be used to secure the upper member to the lower member when the hinge is in the closed position.

11 Claims, 2 Drawing Sheets

FIG. 4.
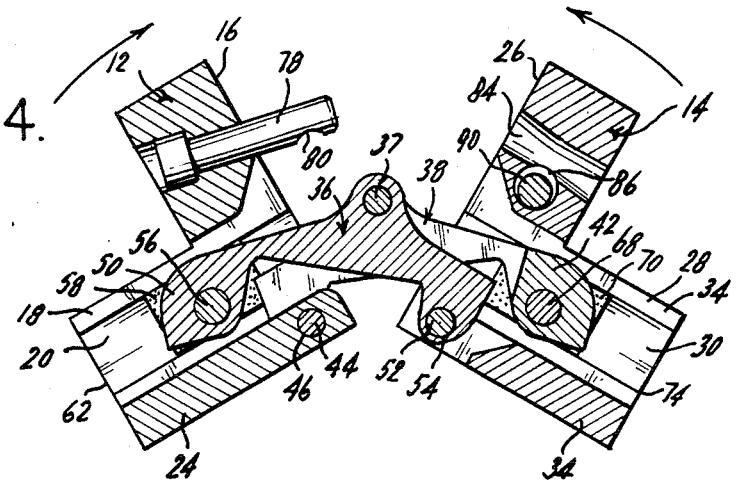
FIG. 5.
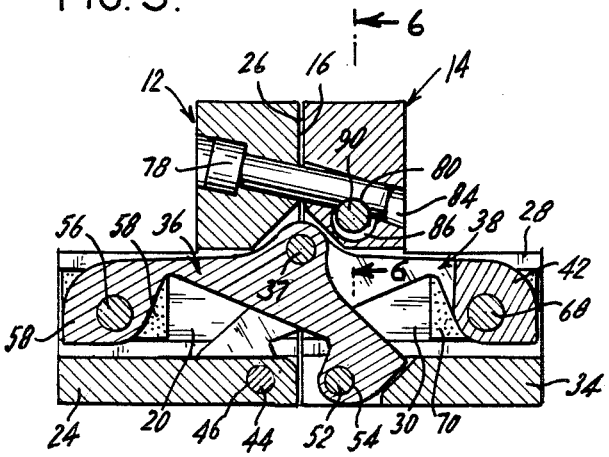
FIG. 7.
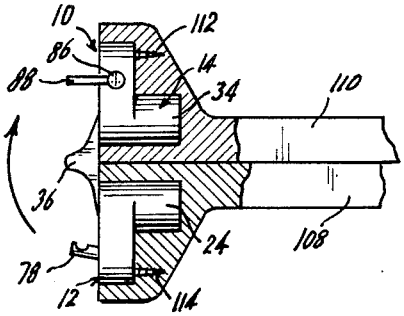
FIG. 8.
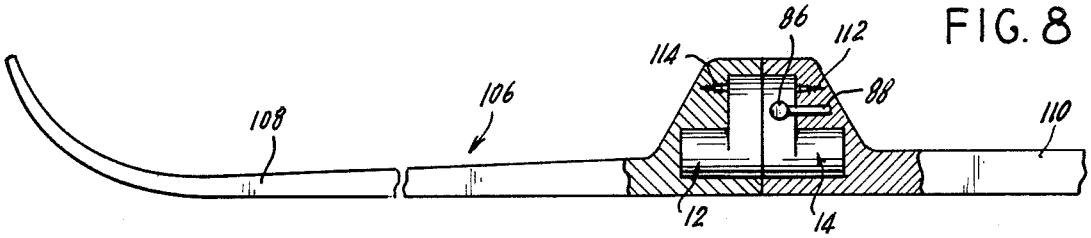
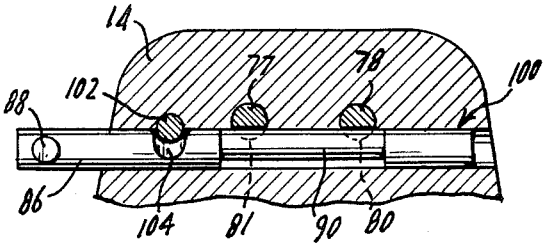
FIG. 6.

HINGE STRUCTURE

BACKGROUND OF THE INVENTION

This invention relates generally to a hinged structure and more particularly to a hinged structure that may be used in combination with a variety of items such as skis or a guitar to make them collapsible for easy storage and transportation.

Items such as guitars and skis, by nature, tend to be long and bulky. When a guitar is not in use it is usually placed in an even longer and bulkier case which requires a large amount of storage space and makes its transportation a cumbersome task. Similarly when a pair of skis is not in use, its long length makes it difficult to carry and a large space is needed to store them. Typically, when skis are transported, they are secured to a ski rack which is placed on top of an automobile. These methods of carrying, transporting and storing items such as skis and guitars are disadvantageous. They add to the cost of the item, require large amounts of storage space and require a fair amount of skill to carry and transport.

A desired item that is typically manufactured as one piece, such as a ski, is made collapsible by taking that particular item, separating it into component elements and hingeably connecting the same. The resultant structure not only allows the ski to function as a single element when use of such items is desired, but also allows the ski to collapse for easy storage or transportation. Items such as skis, if made collapsible, need to be as strong and rigid as their non-collapsible one-piece counterpart during use, and must be able to withstand the stresses and strains to which the skis are normally subjected. While various forms of hinged structures, such as guitars, downhill skis and cross-country skis have been heretofore designed, their hinges cannot be adapted for use in a variety of collapsible items. Further, they do not provide enough overall strength and rigidity to allow such items, when in use, (such as downhill skis) to function, i.e., to be as strong and rigid, as if they were manufactured as single units.

U.S. Pat. No. 4,073,211 of Allen C. Jorgensen issued Feb. 14, 1978; Fr. Pat. No. 2,429,471 of Le Cornec Olivier Etienne Edouard issued February, 1980 and Norway Pat. No. 78,879 of Alvin Westerbotn issued July 30, 1951 relate to foldable stringed musical instruments. The hinges employed in these patents are of relatively simple design and do not possess the requisite strength and rigidity that would enable them to be used in combination with high stress related items such as skis. Further these hinges do not employ locking means to secure the stringed instrument when in use.

U.S. Pat. Nos. 4,262,924 of Charles H. Corwin issued Apr. 21, 1981, 4,125,273 of Karl-Heinz Rothmayer issued Nov. 14, 1978 and 2,367,528 of Cecil B. Rollins issued Jan. 16, 1945 relate to hinged skis. The hinge means employed are manufactured specifically for use in skis and could not be easily adapted for use in other items such as a collapsible guitar.

U.S. Pat. Nos. 3,881,221 of Harold F. Schmidt issued May 6, 1975; 2,021,702 of Joseph Soss issued Nov. 19, 1935; 1,810,508 of Frederick B. Walter issued June 16, 1931; 1,302,178 of Fred J. Korb issued Apr. 29, 1919 and 1,282,435 of Fred J. Korb issued Oct. 22, 1918 relate to hinges designed particularly for use in connection with doors, extension tables and other conventional applications. These hinges are designed primarily for imparting movement. They do not, for example, provide means for securely engaging the hinged structure when in a closed position.

Accordingly, it is an object of the present invention to provide a hinged structure which can be adapted for use in combination with a variety of collapsible items.

Another object of the present invention is to provide a strong and compact hinged structure which when used in combination with a collapsible item is able to equally withstand the stresses of its non-collapsible counterpart when such item is in use.

Still another object of the present invention is to provide a hinged structure which is simple in construction and manufacture.

A further object of the present invention is to provide a hinged structure that is securely locked when in a closed position.

SUMMARY OF THE INVENTION

In accomplishing these and other objects in accordance with the present invention, a floating hinge is composed of a lower member and an upper member. Each member has a surface face and a channel having a pair of guideways located at their distal ends. The channels and guideways extend normal to the surface face for a distance substantially equal to the length of the members. A first arm and a second arm are employed to connect the upper member and the lower member and to provide movement of the members between an open position and a closed position. The first arm has a fixed end pivotably affixed to the lower member and a sliding end pivotably and slidably affixed to the upper member. The second arm has a fixed end pivotably affixed to the upper member and a sliding end pivotably and slidably affixed to the lower member. Further, the arms are pivotably affixed to one another at a location between the fixed ends and the sliding ends. The sliding ends of each of the arms are pivotably and slidably affixed to their respective upper or lower member by a pin and by a pair of floating hinge slides. Each pin engages a pair of floating hinge slides which are fitted within the guideways of the channels of the upper and lower members. In an embodiment of the invention, each floating hinge slide has an eccentrically fixed orifice for engaging each end of the pins. In a further embodiment of the invention means can be used to secure the upper member to the lower member when in the closed position.

Further objects, features and advantages of the present invention will be more fully appreciated by reference to the following detailed description when taken in conjunction with the accompanying drawings. It is to be understood that the drawings are designed for the purposes of illustration only and are not intended as a definition of the limits of the invention.

BRIEF DESCRIPTION OF THE DRAWINGS

In the drawings, wherein similar referenced characters denote similar elements throughout the several figures:

FIG. 4 is the sectional side elevation view of FIG. 3 showing the hinged structure in transition between the open position and a closed position;

FIG. 5 is the sectional side elevation view of FIG. 3 showing the hinged structure in the closed and locked position;

FIG. 6 is a fragmentary sectional front elevational view of the hinged structure of FIG. 5 taken along the lines 6—6 of FIG. 5;

FIG. 7 is a sectional side elevation view of a ski employing the hinged structure of the present invention in the closed and locked position; and FIG. 8 is a sectional side elevation view of the ski of FIG. 7 employing the hinged structure in the open position.

DETAILED DESCRIPTION OF THE PREFERRED EMBODIMENTS

Figure 1:
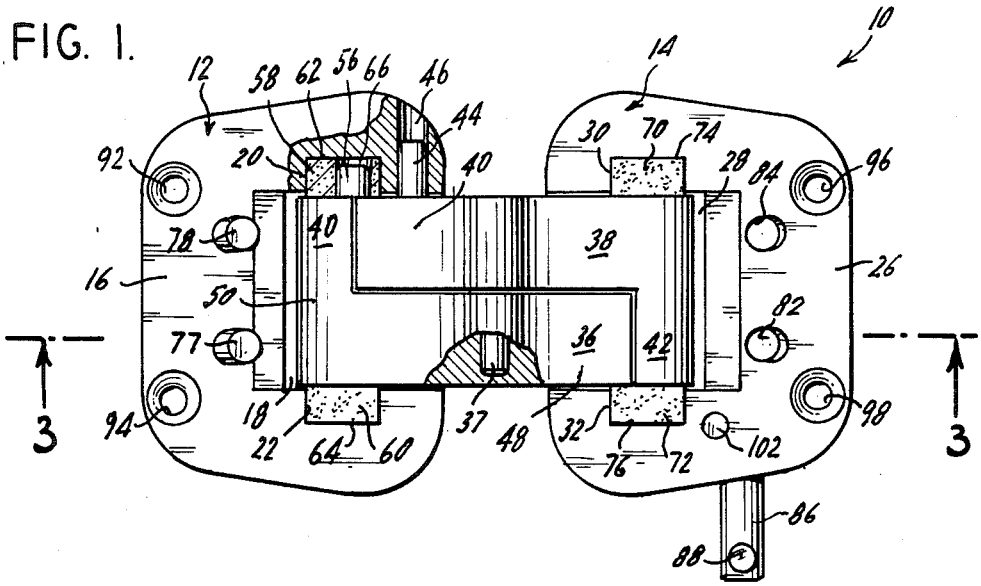
FIG. 1 is a top plan view of the hinged structure of the present invention in an open position.
Figure 2:
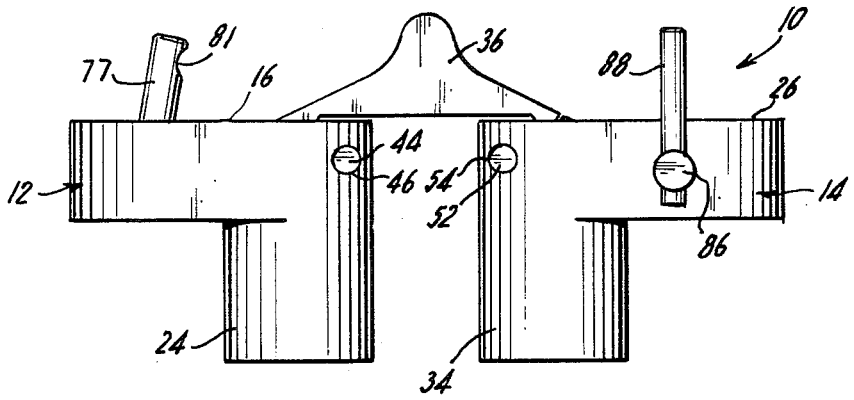
FIG. 2 is a side elevation view of the hinged structure of FIG. 1.

Referring now to FIGS. 1-6, a hinged structure incorporating one embodiment of the present invention is identified generally by the reference numeral 10. The hinged structure 10 is composed of an upper member 12 and a lower member 14. Upper member 12 includes a surface face 16, and a channel 18 including a pair of guideways 20 and 22 located at the distal end of channel 18 and extending normal to the surface face 16 for a distance substantially equal to the length 24 of the upper member 12. Similarly lower member 14 includes a surface face 26 and a channel 28 including a pair of guideways 30 and 32 located at the distal ends of channel 28 and extending normal to the surface face 26 for a distance substantially equal to the length 34 of the lower member 14.

Members 12 and 14 are hingeably connected by a first arm 36 and second arm 38. First arm 36 and second arm 38 are pivotably affixed to one another by a pin 37. Second arm 38 includes a fixed end 40 and a sliding end 42. Fixed end 40 is pivotably affixed to upper member 12 by a pin 44 entering upper member 12 through a channel 46. Similarly first arm 36 includes a fixed end 48 and a sliding end 50. Fixed end 48 is pivotably affixed to lower member 14 by a pin 52 entering lower member 14 through a channel 54 and engaging fixed end 48.

Sliding end 50 of first arm 36 is hingeably and slidably affixed to upper member 12 by a pin 56 and a pair of floating hinge slides 58 and 60. Each floating hinge slide 58 and 60 includes a width corresponding to the widths 62 and 64 of guideways 20 and 22 respectively. Pin 56 engages sliding end 50 and floating hinge slides 58 and 60 and are fitted within guideways 20 and 22. Each floating hinge slide 58 and 60 has an eccentrically fixed orifice, for example orifice 66 of floating hinge slide 58, so that pin 56 is eccentrically located in relation to the widths of guideways 20 and 22 respectively.

Similarly sliding end 42 of arm 38 is pivotably and slidably affixed to lower member 14 by a pair of floating hinge slides 70 and 72. Each floating hinge slide includes a width corresponding to the widths 74, 76 of guideways 30 and 32 respectively. Pin 68 engages sliding end 42 and floating hinge slides 70 and 72 and are fitted within guideways 30 and 32. Each floating hinge slide 70 and 72 has an eccentrically fixed orifice so that pin 68 is eccentrically located in relation to the widths of guideways 30 and 32 respectively.

Upper hinge 12 is formed with a pair of locking pins 77 and 78 each including a notch formed at the pin ends. FIGS. 2-5 depict locking pin 77 with a notch 81. Lower member 14 is formed with a pair of bores 82 and 84 for accepting locking pins 77 and 78 when upper member 12 and lower member 14 are engaged in the closed position as depicted in FIG. 5. Lower member 14 includes a rotatable shaft 86 and a perpendicularly fitted dowel 88. Rotatable shaft 86 includes an eccentric portion 90 which is lined proximate to bores 82 and 84 to form an embedded cam lock which serves to secure upper member 12 and lower member 14 when engaged in the closed position as depicted in FIG. 5. Upper member 12 and lower member 14 are formed with openings 92, 94, 96 and 98 which are used to secure members 12 and 14 to two relatively movable parts by conventional means such as, for example, screws.

Figure 3:
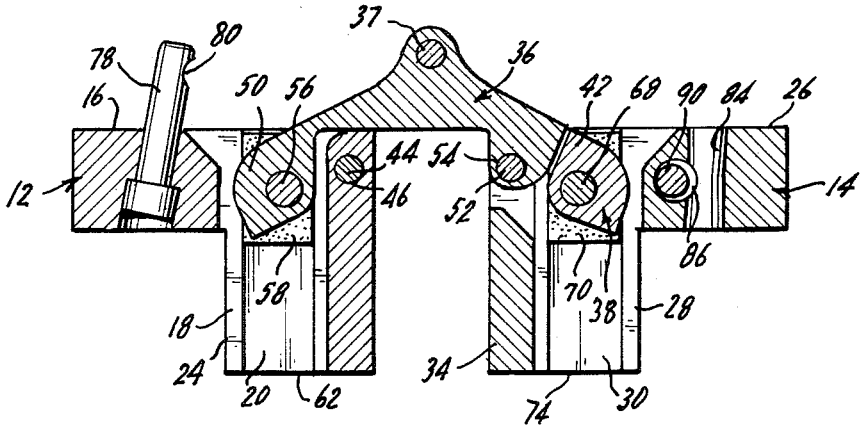
FIG. 3 is a sectional side elevation view of the hinged structure of FIG. 1 taken along the lines 3—3 of FIG. 1.

As shown in FIG. 4, when upper member 12 and lower member 14 are moved between the open position as shown in FIG. 3 and the closed position as shown in FIG. 5, floating hinge slides 58 and 70 slide within guideways 20 and 30 while pivotably supporting sliding ends 50 and 42. First arm 36 is pivotably fixed at fixed end 48 by pin 52 and second arm 38 is pivotably fixed at fixed end 40 by pin 44. First arm 36 and second arm 38 are pivotably fixed to one another by pin 37.

Specifically referring to FIG. 5, floating hinge slides 58 and 70 and sliding ends 42 and 50, respectively, have traveled within guideways 20 and 30 for a distance substantially equal to the lengths 24 and 34 of upper member 12 and lower member 14. Pins 56 and 58 are eccentrically located with respect to guideways 20 and 30 of channels 18 and 28. This allows arms 36 and 38 to be compactly fitted within hinge 10 without sacrificing the load bearing strength of hinge 10.

Referring to FIG. 6, locking pins 77 and 78 are guided by and accepted into bores 82 and 84. Eccentric portion 90 of rotatable shaft 86 is shown to be in locked contact with notches 80 and 81 of locking pins 78 and 77. Rotatable shaft 86 has been rotated with the aid of dowel 80 until eccentric portion 90 is in firm contact with notches 80 and 81 of locking pins 78 and 77, respectively. Pin 102 in conjunction with notch 104 acts to limit the degree rotation of rotatable shaft 86. For example, pin 102 and notch 104 can be constructed to allow a 180 degree of rotation of rotatable shaft 86 between the locked position of FIG. 6 and an unlocked position, not shown, where eccentric portion 90 is not in contact with notches 80 and 81 of locking pins 78 and 77, respectively. Although embedded cam lock 100 is presently shown and described as means for securing upper member 12 and lower member 14 when hinged structure 10 is engaged in the closed position of FIG. 5, other locking means can be employed that act to secure upper member 12 and lower member 14 when hinge 10 is engaged in the closed position of FIG. 5.

Referring now to FIGS. 7-8, hinged structure 10 is shown to be embedded in a ski 106 composed of two relatively movable parts 108 and 110. Upper member 12 is embedded in part 108 by screw 114 and lower member 14 is embedded in part 110 by screw 112. FIG. 7 depicts hinged structure 10 in the closed and locked position allowing ski 106 to be used for the purpose for which it is intended. FIG. 8 shows hinged structure 10 in an open and unlocked position, and ski 106 in a collapsed position by folding part 108 until it meets part 110. In this folded position, ski 106 is now approximately one-half its normal length during use and can now be easily stored and transported.

As will be readily apparent to those skilled in the art, the invention may be used in other specific forms or for other purposes without departing from its spirit or central characteristics. The present embodiment is therefore to be considered as illustrative and not restrictive, the scope of the invention being indicated by the claims rather than by the foregoing description, and all embodiments which come within the range of equivalence of the claims are intended to be embraced.

What is claimed is:

1. A hinged structure comprising:

a lower member and an upper member, each said member having a surface face and a channel, said channel having a pair of guideways located at their distal ends, said channels and said guideways extending normal to said surface face for a distance substantially equal to the length of said upper and lower members;

a first arm and a second arm, said first arm having a fixed end pivotably affixed to said lower member and a sliding end pivotably and slidably affixed to said upper member and said second arm having a fixed end pivotably affixed to said upper member and a sliding end pivotably and slidably affixed to said lower member, said first arm and said second arm pivotably affixed to one another at a location between said fixed ends and said sliding ends, said sliding ends of each of said arms pivotably and slidably affixed to their respective member by a pin engaging an eccentrically fixed orifice of a pair of floating hinge slides fitted within said guideways of said channels of said upper and lower members; and locking means for locking said upper member and lower member in a closed position.

2. A hinged structure as claimed in claim 1, wherein said locking means comprises:

a notched locking pin, affixed to and transversely projected from said upper member, a corresponding bore located in said lower member for accepting said locking pin when said upper member and said lower member are engaged in said closed position, a rotatable shaft rotatably secured to said lower member having an eccentric portion rotatable between a locked position and an unlocked position, said eccentric portion aligned proximate to said corresponding bore and engaging said notch of said locking pin when said lower member and said upper member are engaged in said closed position and when said tubular shaft is rotated to said locked position.

3. A hinged structure as claimed in claim 2, wherein said locking means further comprises:

a 180° constraint for restricting rotation of said rotatable shaft between said locked position and said unlocked position.

4. A hinged structure as claimed in claim 2 wherein said hinged structure is a ski.

5. A hinged structure as claimed in claim 2 wherein said hinged structure is a guitar.

6. A hinged structure comprising:

a lower member and an upper member, each said member having a surface face and a channel, said channels having a pair of guideways located at their distal ends, said channels and said guideways extending to said surface for a distance substantially equal to the length of said upper and lower members;

a first arm and a second arm, said first arm having a fixed end pivotably affixed to said lower member and a sliding end pivotably and slidably affixed to said upper member and said second arm having a fixed end pivotably affixed to said upper member and a sliding end pivotably and slidably affixed to said lower member, said first arm and said second arm pivotably affixed to one another at a location between said fixed ends and said sliding ends, said sliding ends of each of said arms pivotably and slidably affixed to their respective member by a pin engaging a pair of floating hinge slides fitted within said guideways of said channels of said upper and lower members; and lockings means for locking said upper member and said lower member in a closed position.

7. A hinged structure as claimed in claim 6, wherein said locking means comprises:

a notched locking pin affixed to and transversely projecting from said upper member, a corresponding bore located in said lower member for accepting said locking pin when said upper member and said lower member are engaged in said closed position, a rotatable shaft rotatably secured to said lower member having an eccentric portion rotatable between a locked position and an unlocked position, said eccentric portion aligned proximate to said corresponding bore and engaging said notch of said locking pin when said lower hinge member and said upper hinge members are engaged in said closed position and when said tubular shaft is rotated to said locked position.

8. A hinged structure as claimed in claim 7, wherein said locking means further comprises:

a 180° constraint for restricting rotation of said rotatable shaft between said locked position and said unlocked position.

9. A hinged structure as claimed in claim 7 wherein said hinged structure is a ski.

10. A hinged structure as claimed in claim 7 wherein said hinged structure is a guitar.

11. A hinged structure comprising:

a lower member and an upper member, each said member having a surface face and a channel, said channels having a pair of guideways located at their distal ends, said channels and said guideways extending normal to said surface face for a distance substantially equal to the length of said members;

a first arm and a second arm, said first arm having a fixed end pivotally affixed to said lower member and a sliding end pivotably and slidably affixed to said upper member and said second arm having a fixed end pivotally affixed to said upper member and a sliding end pivotally and slidably affixed to said lower member, said first arm and said second arm pivotably affixed to one another at a location between said fixed ends and said sliding ends, said sliding ends of each of said arms pivotably and slidably affixed to their respective hinge member by a pin engaging an eccentrically fixed orifice of a pair of floating hinge slides fitted within said guideways of said channels of said upper and lower members.

* * * * *